US011992068B2

(12) United States Patent
Lee et al.

(10) Patent No.: US 11,992,068 B2
(45) Date of Patent: May 28, 2024

(54) ELASTIC UNIT WITH ADJUSTABLE ELASTICITY AND ELASTIC MODULUS AND OPERATION METHOD THEREOF

(71) Applicant: Chung Ang University Industry Academic Cooperation Foundation, Seoul (KR)

(72) Inventors: Giuk Lee, Gyeonggi do (KR); Jae Wook Ryu, Seoul (KR)

(73) Assignee: CHUNG ANG UNIVERSITY INDUSTRY ACADEMIC COOPERATION FOUNDATION, Seoul (KR)

( * ) Notice: Subject to any disclaimer, the term of this patent is extended or adjusted under 35 U.S.C. 154(b) by 233 days.

(21) Appl. No.: 17/576,401

(22) Filed: Jan. 14, 2022

(65) Prior Publication Data

US 2023/0069521 A1 Mar. 2, 2023

(30) Foreign Application Priority Data

Sep. 2, 2021 (KR) ..... 10-2021-0117079

(51) Int. Cl.
*A41D 13/05* (2006.01)
*A63B 21/055* (2006.01)

(52) U.S. Cl.
CPC ..... *A41D 13/0506* (2013.01); *A63B 21/0555* (2013.01)

(58) Field of Classification Search
CPC ..... A41D 13/0506; A63B 21/0555; A63B 21/4025; A63B 21/00076; A61H 2201/1253; A61H 1/0244; A61H 2201/1642; A61H 2201/1652
See application file for complete search history.

(56) References Cited

U.S. PATENT DOCUMENTS 6,322,483 B1 * 11/2001 Rotella ..... A63B 21/1654 482/121
8,979,716 B1 * 3/2015 Rawlins ..... A63B 21/4043 482/129
9,427,622 B2 * 8/2016 Thrasher-Rudd ..... A63B 23/1209
10,532,240 B2 * 1/2020 Thrasher-Rudd ..... A63B 7/00
10,675,501 B2 * 6/2020 Vorozilchak ..... A63B 21/1681
10,888,485 B2 * 1/2021 Fleming ..... A61H 1/0255
11,213,713 B2 * 1/2022 Bettini ..... A63B 21/151
(Continued)

FOREIGN PATENT DOCUMENTS

KR 10-1557319 B1 10/2015
KR 10-2012-0012759 A 6/2017
(Continued)

*Primary Examiner* — Garrett K Atkinson
(74) *Attorney, Agent, or Firm* — Akerman LLP

(57) ABSTRACT

The present disclosure relates to an elastic unit with adjustable elasticity and elastic modulus and to an operation method thereof. In particular, the present disclosure relates to an elastic unit with adjustable elasticity and elastic modulus, which comprises: an elastic element having a plurality of division areas longitudinally; and elasticity adjustment modules that are laid out in each of the division areas of the elastic element and activate or inactivate the elastic element partially depending on the division areas to adjust an elasticity and an elastic modulus of the elastic element.

11 Claims, 6 Drawing Sheets

(56) References Cited

U.S. PATENT DOCUMENTS

| | | | | |
|---|---|---|---|---|
| 2011/0251033 | A1* | 10/2011 | Blancher | A63B 22/16 482/123 |
| 2012/0053027 | A1* | 3/2012 | Hetrick | A63B 21/0442 482/124 |
| 2013/0165301 | A1* | 6/2013 | Thrasher-Rudd | A63B 7/00 482/129 |
| 2013/0212898 | A1* | 8/2013 | Reynolds | A45C 13/30 34/239 |
| 2015/0283420 | A1* | 10/2015 | Chang | A63B 21/0442 482/121 |
| 2017/0225024 | A1* | 8/2017 | Thrasher-Rudd | A63B 21/4035 |
| 2018/0140894 | A1* | 5/2018 | Ross | A63B 21/08 |
| 2018/0318631 | A1* | 11/2018 | Siu | A63B 21/0442 |
| 2019/0282849 | A1* | 9/2019 | Val Balent | A63B 71/0054 |
| 2023/0293928 | A1* | 9/2023 | Hughes | A63B 21/00043 482/126 |

FOREIGN PATENT DOCUMENTS

| | | | |
|---|---|---|---|
| KR | 10-1217672 | B1 | 8/2017 |
| KR | 10-2069601 | B1 | 1/2020 |

* cited by examiner

Prior Art 2

ELASTIC UNIT WITH ADJUSTABLE ELASTICITY AND ELASTIC MODULUS AND OPERATION METHOD THEREOF

CROSS-REFERENCE TO RELATED APPLICATIONS

This application claims priority and benefit of Korean Patent Application No. 10-2021-0117079 filed on Sep. 2, 2021, in the Korean Intellectual Property Office, the disclosure of which is hereby incorporated by reference in its entirety.

BACKGROUND

Field

The present disclosure relates to an elastic unit with adjustable elasticity and elastic modulus and to an operation method thereof.

Description of the Related Art

Elastic members are known and are been used in various technical fields, mainly for damping of vibrations and forces. A spring member has a restricted stiffness that was pre-determined depending on the type, size, shape and number of an elastic body layer. In general, the spring member is not allowable either to be change or to be change prominently, following the installation thereof.

A rubber band has such a characteristic that the more the band is stretched, the more the elasticity is increased, allowing supporting a body passively when applied to either physical training exercises or passive wearable robots. However, common rubber bands create elasticities depending on inherent elastic moduli thereof, resulting in extremely restricted uses thereof.

Studies are continued to vary the elasticity of these elastic members. FIG. 1 illustrates a perspective view of an elasticity variable sound insulating member into which an elastic material according to the prior art 1 is inserted. FIG. 2 illustrates a perspective view of a tube structure to which a variable stiffness mechanism according to the prior art 2 is applied.

In a case of the prior art 1, that is, the elasticity variable sound insulating member into which the elastic material is inserted, an elasticity is changed as a distance between an inner plate unit and an outer plate unit is changed, allowing creating only an elasticity within a certain elasticity modulus.

In a case of the prior art 2, that is, the tube structure to which the variable stiffness mechanism is applied, this structure has a long tube form in which a stiffness for a vertical force of a main axis is changed depending on relative rotation and movement of an outer tube and an inner tube. Therefore, this structure is required to be fixed to avoid being rotated, resulting in the restricted use of the same.

The prior art 1 may change an elasticity along only the same elastic modulus with changing the distance between the inner plate unit and the outer plate unit. The prior art 2 requires a fixation part to avoid this tube structure being rotated because the stiffness for the vertical force of the main axis is changed.

Accordingly, it is demanded to develop an elastic unit with adjustable elasticity and elastic modulus, which is capable of changing both elasticity and elastic modulus with maintaining the overall length of a system and which, as the elasticity for the vertical force of the main axis is changed, is usable variously without being affected by the rotation.

Prior Art Documents

Patent Document (Patent Document 1) Korean Patent No. 10-1557319
(Patent Document 2) Korean Patent No. 10-2069601
(Patent Document 3) Korean Patent No. 10-1217672
(Patent Document 4) Korean Patent Laid-Open Publication No. 10-2012-012759

SUMMARY

The present disclosure is provided to solve problems according to the prior arts as described above. According to the embodiment of the present disclosure, an object to be achieved in the present disclosure is to provide an elastic unit with adjustable elasticity and elastic modulus and an operation method thereof. The elastic unit is a band typed mechanism that is capable of adjusting both magnitude of elasticity and elastic modulus, allowing much more support to result in the high degree of usability thereof.

According to the embodiment of the present disclosure, an object to be achieved in the present disclosure is to provide an elastic unit with adjustable elasticity and elastic modulus and an operation method thereof, wherein the elastic unit is generally composed of an elastic band, an inelastic band (nylon webbing) and fixation portions, sections divided with respect to the fixation portions are laid out in each interval of the long elastic band, the inelastic band is connected with the elastic band in parallel in each of the sections, the inelastic band is fixed to one side of the fixation portion within the section and connected with a spool of another side of the fixation portion, allowing adjusting a length of the nylon webbing within the corresponding section by rotating the spool with a motor.

According to the embodiment of the present disclosure, an object to be achieved in the present disclosure is to provide an elastic unit with adjustable elasticity and elastic modulus and an operation method thereof, wherein an elasticity is adjusted with activating or inactivating the elastic band by adjusting a length of the inelastic band in each section, the elastic band within that section is not allowable to be stretched (inactivation) when the length of the inelastic band is the same as the elastic band but is available to be stretched (Activation) when the length of the inelastic band is longer than the elastic band, elasticity stages appear through the activation and inactivation of the elastic band as many as the number of the sections, and an elastic body of a certain section is made of a rubber cord so as to show much smaller elasticity than the elastic band.

Further, according to the embodiment of the present disclosure, an object to be achieved in the present disclosure is to provide an elastic unit with adjustable elasticity and elastic modulus and an operation method thereof, wherein the elastic band is stretched in the beginning of tensile behavior when subjecting the length of the inelastic band to be slightly longer than the elastic band and then can no longer be stretched from that moment the length thereof becomes the same as a length of nylon webbing, allowing appearing various elastic moduli besides existing elasticity stages using this principal.

Meanwhile, technical objects to be achieved by the present disclosure are not limited to the aforementioned objects, and other not-mentioned technical objects may be clearly understood by those skilled in the art to which the present disclosure pertains from the description below.

In one aspect described herein, the first object of the present disclosure may be achieved by an elastic unit with adjustable elasticity and elastic modulus, the elastic unit including an elastic element having a plurality of division areas longitudinally; and elasticity adjustment modules that are laid out in each of the division areas of the elastic element and activate or inactivate the elastic element partially depending on the division areas to adjust an elasticity and an elastic modulus of the elastic element.

Further, the elastic element is made of an elastic band, and the elastic adjustment module includes an inelastic band of which one side end is fixed to one side end of a division area of the elastic band and a length adjuster that is installed to another side end of the division area to adjust an exposure length of the inelastic band.

In another aspect described herein, an elasticity of the elastic band in a division area may be activated when applying no tensile strength to the inelastic band, while inactivated when decreasing the exposure length of the inelastic band by the length adjuster to create a tensile strength in the inelastic band.

Further, the inelastic band is made of a nylon webbing, and the length adjuster includes a spool that winds one side of the nylon webbing and a motor that rotatably drives the spool.

In another aspect described herein, the elastic unit may further include a control part that controls driving of the motor of the length adjuster.

Further, an elasticity of the elastic unit is varied and adjusted through a change in the number of inactivated division areas.

In another aspect described herein, in an activated division area, an elastic modulus of the elastic unit is varied and adjusted depending on the exposure length of the inelastic band.

Further, the elastic element that is laid out in a certain division area has a smaller elastic modulus than an elastic modulus of the elastic band.

In one aspect described herein, the second object of the present disclosure may be achieved by an operation method of the elastic unit with adjustable elasticity and elastic modulus as mentioned in the first object above, the method including: storing and discharging elasticity in and to the elastic unit depending on a variation in forces applied to an elastic element longitudinally; and adjusting an elasticity and an elastic modulus of the elastic element by activating and inactivating the elastic element partially depending on division areas with elasticity adjustment modules that are laid out in each of the division areas of the elastic element.

Further, an elasticity of the elastic unit is varied and adjusted through a change in the number of inactivated division areas, and in an activated division area, an elastic modulus of the elastic unit is varied and adjusted depending on an exposure length of an inelastic band.

In one aspect described herein, the third object of the present disclosure may be achieved by a hip elastic suit comprising the elastic unit as mentioned in the first object above.

Further, the suit may further include: an assistive force measurement portion that measures an assistive force resulting from the elastic unit in real time in a state of wearing the suit; and a control part that controls the assistive force by adjusting an elasticity and an elastic modulus of the elastic unit by controlling an elasticity adjustment module based on a measured assistive force.

Advantageous Effect

According to the elastic unit with adjustable elasticity and elastic modulus and the operation thereof in accordance with the embodiment of the present disclosure, the elastic unit is a band typed mechanism that is capable of adjusting both magnitude of elasticity and elastic modulus, allowing much more support to result in the high degree of usability thereof.

According to the elastic unit with adjustable elasticity and the elastic modulus and an operation thereof in accordance with the embodiment of the present disclosure, the elastic unit is generally composed of an elastic band, an inelastic band (nylon webbing) and fixation portions, sections divided with respect to the fixation portions are laid out in each interval of the long elastic band, the inelastic band is connected with the elastic band in parallel in each of the sections, and the inelastic band is fixed to one side of the fixation portion within the section and connected with a spool of another side of the fixation portion, thereby advantageously adjusting a length of the nylon webbing within the corresponding section by rotating the spool with a motor.

According to the elastic unit with adjustable elasticity and elastic modulus and an operation thereof in accordance with the embodiment of the present disclosure, elasticity is adjusted with activating or inactivating the elastic band by adjusting a length of the inelastic band in each of the sections, and the elastic band within that section is not allowable to be stretched (inactivation) when the length of the inelastic band is the same as the elastic band but can be stretched (Activation) when the length of the inelastic band is longer than the elastic band, thereby advantageously showing elasticity stages through the activation and inactivation of the elastic band as many as the number of the sections.

According to the elastic unit with adjustable elasticity and elastic modulus and an operation thereof in accordance with the embodiment of the present disclosure, the elastic band is stretched in the beginning of tensile behavior when subjecting the length of the inelastic band to be slightly longer than the elastic band and then can no longer be stretched from that moment the length thereof becomes the same as a length of nylon webbing, thereby advantageously showing various elastic moduli besides existing elasticity stages using this principal.

Meanwhile, advantageous effects to be obtained by the present disclosure are not limited to the aforementioned effects, and other not-mentioned advantageous effects may be clearly understood by those skilled in the art to which the present disclosure pertains from the description below.

BRIEF DESCRIPTION OF THE DRAWINGS

The accompanying drawings in the specification illustrate an embodiment of the present disclosure. The technical essence of the present disclosure will be more clearly understood from the following detailed description taken in conjunction with the accompanying drawings.

Therefore, the present disclosure will not be interpreted to be limited to the drawings in which.

DETAILED DESCRIPTION OF THE PREFERRED EMBODIMENT

Figure 1:
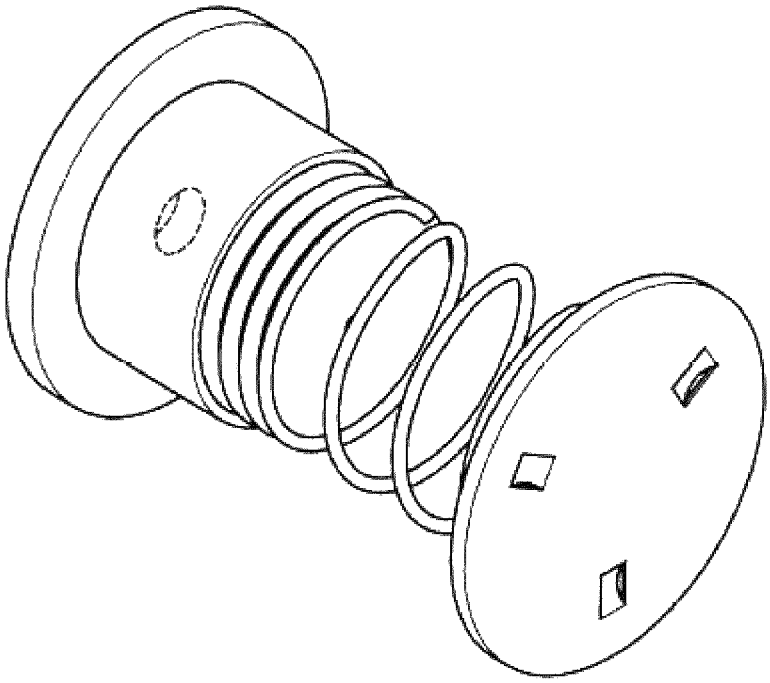
FIG. 1 is a perspective view of an elasticity variable sound insulating member into which an elastic material according to the prior art 1 is inserted.
Figure 2:
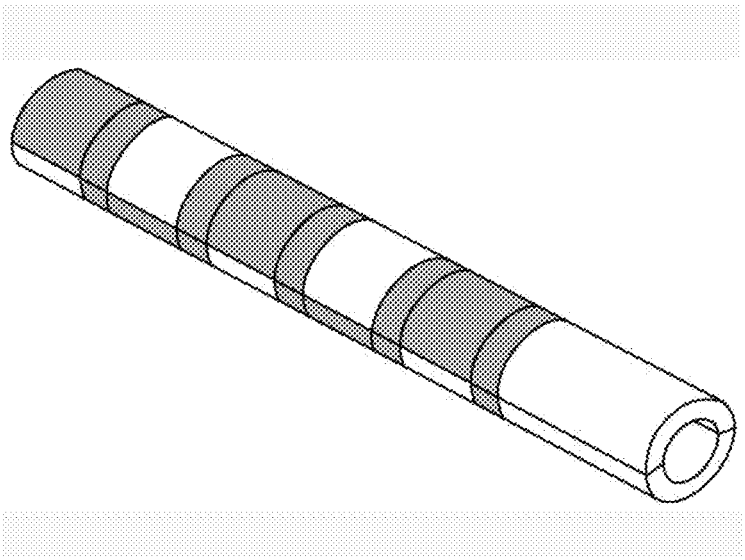
FIG. 2 is a perspective view of a tube structure to which a variable stiffness mechanism according to the prior art 2 is applied.

The above and other objects, features and other advantages of the present disclosure will be more clearly understood from the following detailed description taken in conjunction with the accompanying drawings. However, the present disclosure may be embodied as different forms without limited to embodiments as herein described. On the contrary, the embodiments as herein introduced are afforded to make disclosed contents thorough and complete and sufficiently transfer the essence of the present disclosure to those skilled in the art.

In the specification, when an element is referred to as being "on" other element, it means that the element may be directly on the other element, or an intervening third element may be provided between them. Further, in the drawings, thicknesses of elements may be exaggerated for describing the technical content effectively.

Embodiments as herein described may be described with reference to cross-sectional views and/or plan views that are ideal exemplary views of the present disclosure. Further, in the drawings, thicknesses of a film and regions are exaggerated for describing the technical content effectively. Therefore, a type of an exemplary view may be modified by a manufacturing technology and/or an allowable error. Accordingly, the embodiments of the present disclosure are not limited to specific illustrated types, but may include modified types generated in accordance with the manufacturing process. For example, a region illustrated as a right angle may be rounded or have a predetermined curvature. Therefore, regions that are illustrated in the drawings have properties. Shapes of the regions illustrated in the drawings are provided to illustrate specific types of the region of an element, but not to limit the scope of the present disclosure. Although the terms "first", "second", and the like are used for describing various configuration elements, these configuration elements are not confined by these terms. These terms are merely used for distinguishing one configuration element from the other configuration elements. The embodiments as herein described include complementary embodiments thereto.

The terms as herein used are for explaining the embodiments rather than limiting the present disclosure. Unless particularly stated otherwise, in the present specification, a singular form also includes a plural form. The terms "comprises" and/or "comprising" as herein used do not exclude the existence or addition of one or more other configuration elements.

When describing the following specific embodiments, various specific contents are provided for more specific description and understanding of the present disclosure. However, those skilled in the art may understand that the specific embodiments may be described without using the various specific contents. In some cases, configurations that are generally known but do not directly relate to the present disclosure will be omitted in order to avoid confusion.

Hereinafter, described are configurations, functions and an operation method of an elastic unit with adjustable elasticity and elastic modulus according to the present disclosure.

Figure 3:
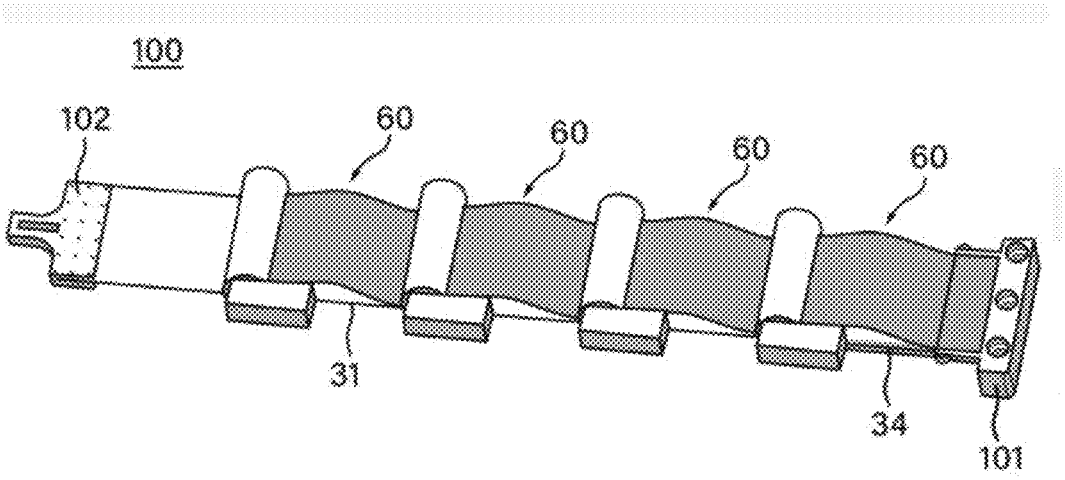
FIG. 3 is a perspective view of an elastic unit with adjustable elasticity and elastic modulus according to the embodiment of the present disclosure.
Figure 4:
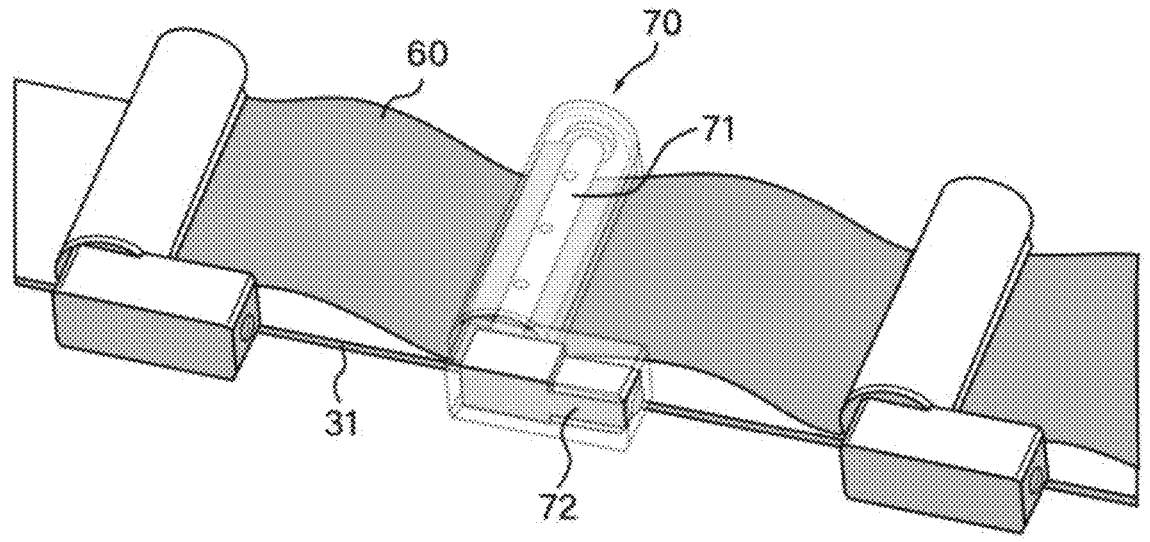
FIG. 4 is an enlarged perspective view of FIG. 3.
Figure 5:
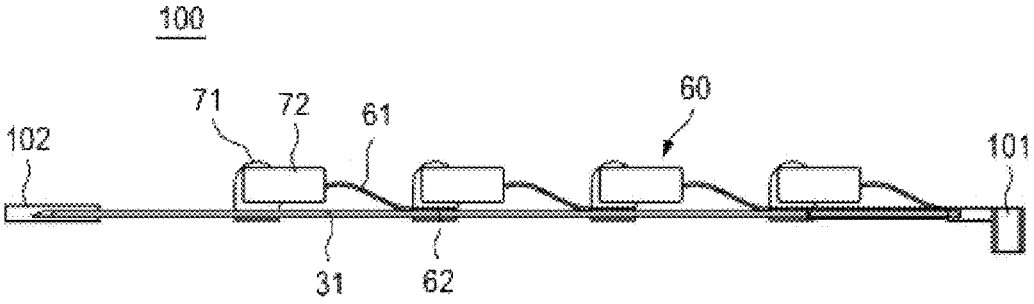
FIG. 5 is a side view of an elastic unit with adjustable elasticity and elastic modulus according to the embodiment of the present disclosure.
Figure 6:
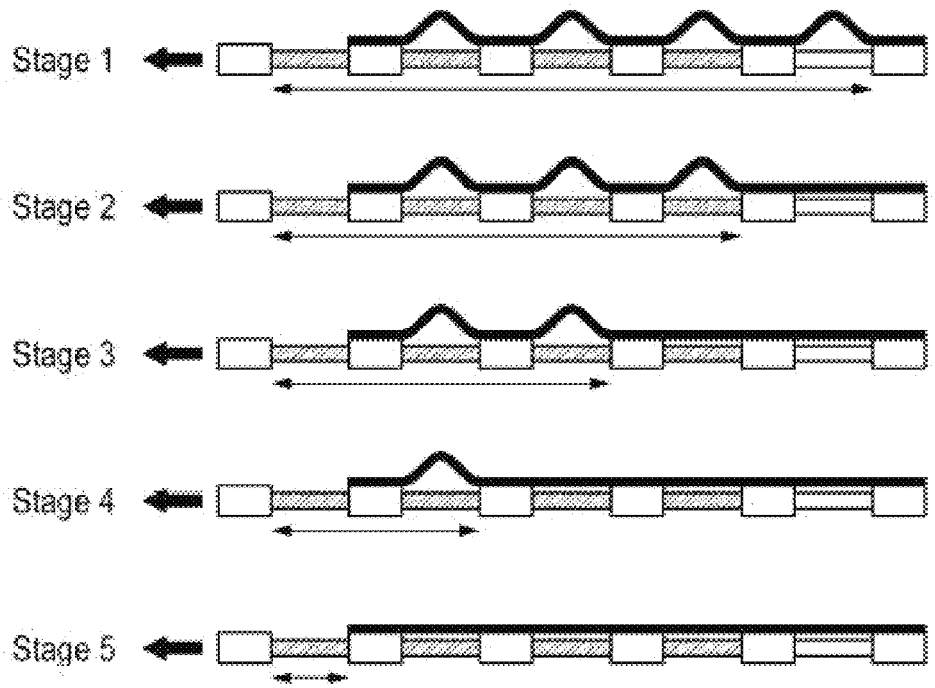
FIG. 6 is a schematic view showing changes of activated sections by division areas depending on stages according to the embodiment of the present disclosure.

FIG. 3 is a perspective view of an elastic unit with adjustable elasticity and elastic modulus according to the embodiment of the present disclosure. FIG. 4 is an enlarged perspective view of FIG. 3. Further, FIG. 5 is a side view of an elastic unit with adjustable elasticity and elastic modulus according to the embodiment of the present disclosure. FIG. 6 is a schematic view showing changes of activated sections by division areas as many as stages according to the embodiment of the present disclosure, An elastic unit 100 with adjustable elasticity and elastic modulus according to the embodiment of the present disclosure may be configured to include an elastic element 31 having a plurality of division areas longitudinally and elasticity adjustment modules 60 that are laid out in each of the division areas of the elastic band 31 and activate or inactivate the elastic band 31 partially depending on the division areas to adjust an elasticity and an elastic modulus of the elastic band 31.

As shown in FIGS. 3 to 5, the elasticity adjustment modules 60 according to the embodiment of the present disclosure are laid out in each of the division areas, the respective elastic adjustment modules 60 configured to include an inelastic band 61 and a length adjuster 70. The inelastic band 61 is fixed to one side of a fixation end 62 and another end thereof is wound by a length adjuster 70 to adjust an exposure length of the inelastic band 61.

That is, one side end of the inelastic band 61 is fixed to one side end of the division area, and the length adjuster 70 is installed to another side end of the division area, allowing adjusting the exposure length.

Accordingly, an elasticity of the elastic band 31 in the division area is activated when applying no tensile strength to the inelastic band 61, while the elasticity of the elastic band 31 in that division area is inactivated when decreasing the exposure length of the inelastic band 61 by the length adjuster 70 to create a tensile strength in the inelastic band.

In the embodiment of the present disclosure, the inelastic band 61 is may made of a nylon webbing and the length adjuster may be configured to include a spool 71 that winds and rewinds another side of the nylon webbing 61 and a motor 72 that dives this spool 71. Further, a control part controls driving of the motor 72 of the length adjuster 70.

Accordingly, an elasticity of the elastic unit 100 is varied and controlled through a change in the number of inactivated division areas.

That is, sections divided as division areas with respect to the fixation ends 62 are laid out in each interval of the long elastic band 31, and the nylon webbing 61 is connected with the elastic band 31 in parallel in each of the sections. The nylon webbing 61 is fixed to one side of the fixation end 62 within the section and another side thereof is connected with the spool 71. Therefore, it is allowable to adjust a length of the nylon webbing 61 within the corresponding section by rotating the spool 71 with a motor 71.

The principle of such a mechanism is to adjust elasticity with activating or inactivating the elastic band 31 by adjusting the length of the nylon webbing 61 in each of the sections. The elastic band 31 within the section is not allowable to be stretched when the length of the nylon webbing 61 is the same as the elastic band 31, while the elastic band of that section can be stretched when the length of the nylon webbing 61 is longer than that of the elastic band 31.

As shown in FIG. 6, elasticity stages may appear through the activation and inactivation of the elastic band 31 as many as the number of the sections. Further, an elastic body within one section is made of a rubber cord 34 to show much smaller elasticity than the elastic band 31.

In the particular embodiment of the present disclosure, as the elastic band 31, used is an exercise rubber band having a thickness of 2 mm, which is cut out to fit a width of the nylon webbing. As the fixation end 62, used is an output that is made from an ABS material using the single 3D printer manufactured by "Cubicon". It is identified that the magnitude of the elasticity and the elastic modulus are adjustable through the test. Also, verified is the change in assistive forces through the application to the "Hip flexion exosuit".

Further, in the activated division area, the elastic modulus of the elastic unit 100 is varied and adjusted depending on the exposure length of the inelastic band 61.

Figure 7A:
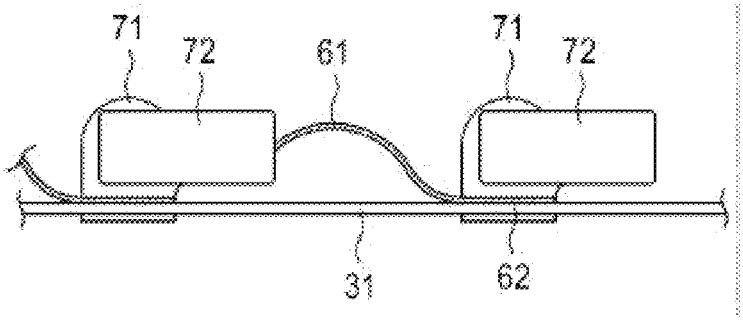
FIG. 7A is a partial side view of an elasticity adjustment module in which a nylon webbing has a first length according to the embodiment of the present disclosure.
Figure 7B:
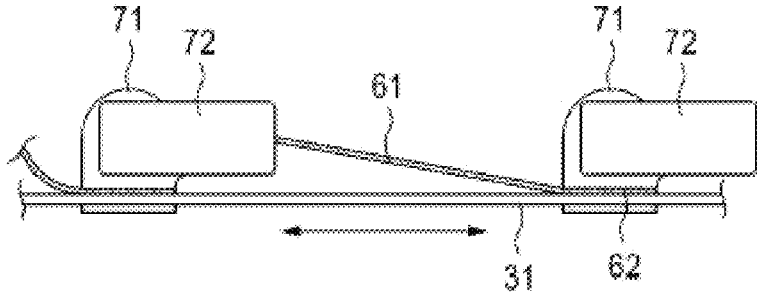
FIG. 7B is a partial side view showing a state having the maximum elasticity in FIG. 7A.

FIG. 7A is a partial side view of an elasticity adjustment module in which a nylon webbing has a first length according to the embodiment of the present disclosure and FIG. 7B is a partial side view of an elasticity adjustment module in which a nylon webbing has a first length according to the embodiment of the present disclosure. On the other hand, FIG. 8A is a partial side view of an elasticity adjustment module in which a nylon webbing has a second length shorter than the first length according to the embodiment of the present disclosure and FIG. 8B is a partial side view showing a state having the maximum elasticity in FIG. 8A.

Figure 8A:
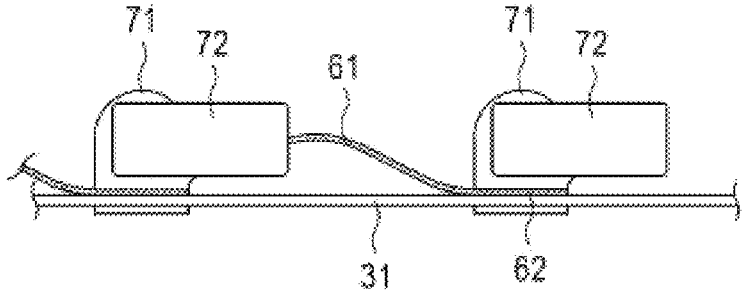
FIG. 8A is a partial side view of an elasticity adjustment module in which a nylon webbing has a second length shorter than the first length according to the embodiment of the present disclosure.
Figure 8B:
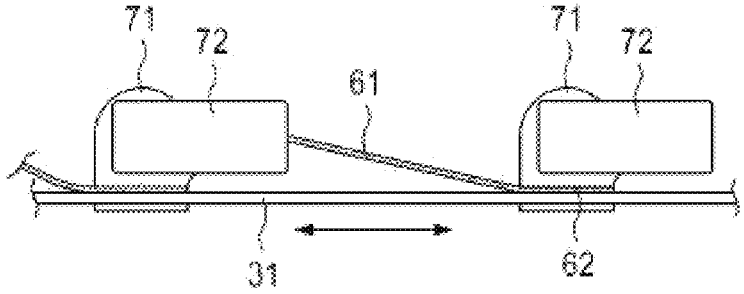
FIG. 8B is a partial side view showing a state having the maximum elasticity in FIG. 8A.

As shown in FIGS. 8A and 8B, when subjecting the length of the nylon webbing 61 to be slightly longer than the elastic band 31, the elastic band 31 is stretched in the beginning of tensile behavior and then can no longer be stretched from that moment the length thereof becomes the same as the length of the nylon webbing 61. Various elastic moduli besides existing elasticity stages may appear using this principal.

That is, in FIG. 7A, the exposure length of the inelastic band 61 is longer as compared to FIG. 8A. In such a case, as shown in FIG. 7B, the elasticity modulus becomes larger as compared to FIG. 8B. Accordingly, the exposure length of the nylon webbing 61 is adjusted by the spool 71 within the activated section to adjust the elasticity that is storable maximally, i.e., the elastic modulus.

Figure 9:
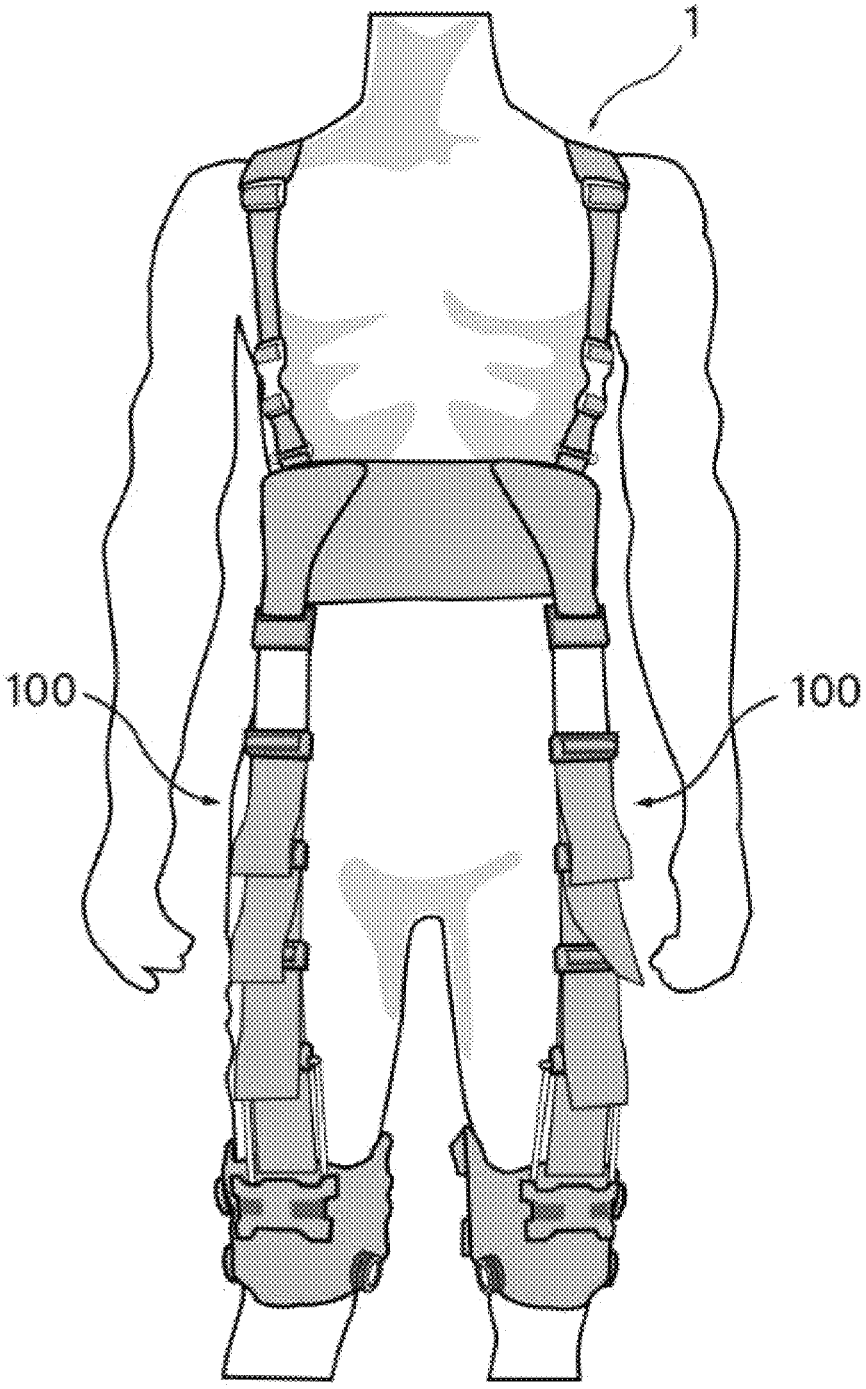
FIG. 9 is a picture of a hip elastic suit to which the elastic unit with adjustable elasticity and elastic modulus is applied according to the embodiment of the present disclosure.

FIG. 9 is a picture of an elastic suit to which the elastic unit with adjustable elasticity and elastic modulus is applied according to the present disclosure. As shown in FIG. 9, a hip elastic suit 1 is manufactured, which is fitted with the aforementioned elastic unit with adjustable elasticity and elastic modulus.

In a state of wearing this elastic suit 1, the assistive force is measured in real time through an assistive force measurement portion. Further, the control unit controls the elasticity adjustment module to adjust the elasticity and elastic modulus of the elastic unit.

Further, the aforementioned apparatus and method are not limited to configurations and methods of the above-described embodiments. Alternatively, the embodiments may be configured to selectively combine the whole of the respective embodiments or a part thereof, allowing various modifications.

DESCRIPTION OF THE SYMBOLS

1. Hip elastic suit
31. Elastic band
34. Rubber cord
60. Elasticity adjustment module
61. Inelastic band
62. One side of fixation end
70. Length adjuster
71. Spool
72. Motor
100. Elastic unit with adjustable elasticity and elastic modulus
101. One side of fitting end
102. Another side of fitting end

What is claimed is:

1. An elastic unit with adjustable elasticity and elastic modulus, the elastic unit comprising:
- an elastic element having a plurality of division areas longitudinally; and
- elasticity adjustment modules that are each laid out in a respective one of the division areas of the elastic element and that each activate or inactivate a respective portion of the elastic element within the respective one of the division areas to adjust the elasticity and the elastic modulus of the unit.

2. The elastic unit of claim 1, wherein
- the elastic element is made of an elastic band,
- each of the elasticity adjustment modules includes:
  - an inelastic band of a respective elasticity adjustment module, of which one side end of the inelastic band of the respective elasticity adjustment module is fixed to one side end of the respective one of the division areas of the elastic band of the elastic element; and
  - a length adjuster of the respective elasticity adjustment module that is installed to another side end of the respective one of the division areas to adjust an exposure length of the inelastic band of the respective elasticity adjustment module.

3. The elastic unit of claim 2, wherein
- an elasticity of the elastic band of the elastic element in the respective one of the division areas is activated when applying no tension to the inelastic band of the respective elasticity adjustment module, and inactivated when decreasing the exposure length of the inelastic band of the respective elasticity adjustment module by the length adjuster of the respective elasticity adjustment module to create tension in the inelastic band of the respective elasticity adjustment module.

4. The elastic unit of claim 3, wherein
- the inelastic band of the respective elasticity adjustment module is made of a nylon webbing,
- the length adjuster of the respective elasticity adjustment module includes a spool that winds one side of the nylon webbing and a motor that rotatably drives the spool.

5. The elastic unit of claim 4, further comprising:

a control part that controls driving of the motor of the length adjuster of the respective elasticity adjustment module.

6. The elastic unit of claim 4, wherein the elasticity of the elastic unit is configured to be varied and adjusted through a change in the number of inactivated division areas.

7. The elastic unit of claim 6, wherein when a division area is activated, the elastic modulus of the elastic unit is varied and adjusted depending on the exposure length of the inelastic band of the respective elasticity adjustment module.

8. An operation method of the elastic unit with adjustable elasticity and elastic modulus as claimed in claim 1, the method comprising:

storing and discharging the elasticity in and to the elastic unit depending on a variation in forces applied to the elastic element longitudinally; and adjusting the elasticity and the elastic modulus of the elastic unit by activating and inactivating one or more of the respective portions of the elastic element that are each within the respective one of the division areas with the elasticity adjustment modules that are each laid out in the respective one of the division areas of the elastic element.

9. The operation method of claim 8, wherein the elasticity of the elastic unit is varied and adjusted through a change in the number of inactivated division areas, when a division area is activated, the elastic modulus of the elastic unit is varied and adjusted depending on an exposure length of an inelastic band of a respective elasticity adjustment module laid out in the activated division area.

10. A hip assistive elastic suit comprising the elastic unit as claimed in claim 1.

11. The elastic suit of claim 10, further comprising:

an assistive force measurement portion that measures an assistive force resulting from the elastic unit in real time in a state of wearing the suit; and a control part that controls the assistive force by adjusting the elasticity and the elastic modulus of the elastic unit by controlling the elasticity adjustment modules based on a measured assistive force.

* * * * *